US006957809B1

(12) United States Patent
Ferrara et al.

(10) Patent No.: US 6,957,809 B1
(45) Date of Patent: Oct. 25, 2005

(54) DOVETAIL VISE JAW PLATE ASSEMBLY

(75) Inventors: William Ferrara, Sunrise, FL (US); Alvin S. Blum, Fort Lauderdale, FL (US)

(73) Assignee: Vise Jaws Inc., Deerfield Beach, FL (US)

( * ) Notice: Subject to any disclaimer, the term of this patent is extended or adjusted under 35 U.S.C. 154(b) by 0 days.

(21) Appl. No.: 10/835,764

(22) Filed: Apr. 29, 2004

(51) Int. Cl.[7] ..... B25B 1/24
(52) U.S. Cl. ..... 269/283; 269/282; 269/287
(58) Field of Search ..... 269/282, 283, 269/287, 279, 280, 281, 271, 275, 261, 262; 279/123, 124, 152, 153; 403/381

(56) References Cited

U.S. PATENT DOCUMENTS 1,372,726 A 3/1921 Sloan
1,454,148 A 5/1923 Bisset
4,216,950 A 8/1980 Mason
4,221,391 A 9/1980 Dutton
4,573,669 A 3/1986 Gerry
4,969,637 A 11/1990 Nishimura
5,037,075 A 8/1991 Durfee
5,065,990 A 11/1991 Durfee
5,150,888 A 9/1992 Durfee
5,163,664 A 11/1992 Calaio
6,446,952 B1 9/2002 Sheehy

*Primary Examiner*—Robert C. Watson
(74) *Attorney, Agent, or Firm*—Alvin S. Blum

(57) ABSTRACT

A vise jaw assembly can be easily mounted on, and removed from, the jaws of a machine vise. A first reusable component bolts onto the face of a machine vise jaw. A second component is inexpensive and disposable. It is made by extrusion of an easily machinable material such as aluminum. It has a flat face that is designed to engage a flat face of the first component. It has an element extending from the flat face such as a dovetail element that slides laterally into a correspondingly shaped recess in the first component to complete a dovetail type joint. A slot below the recess in the first component is compressed by threaded fasteners to tighten the joint. The second component has a uniform cross section so that it may be produced by extrusion with minimal finishing except for cutting to length.

18 Claims, 3 Drawing Sheets

DOVETAIL VISE JAW PLATE ASSEMBLY

This invention relates to work holding vises, and more particularly to readily replaceable machinable plates and their attachment to the jaws of vises.

BACKGROUND OF THE INVENTION

When machining a work piece, the piece must be securely mounted in a vise on the machine so that the forces of machining do not move the piece and destroy precision. The mounting of the piece in the vise may consume a considerable portion of the labor cost of machining. It is often desirable to machine one or both jaws, so that a work piece may be more effectively held therein against the machining forces. Vise jaws are complex and expensive to replace once they have been altered for a particular task. U.S. Pat. No. 5,893,551 issued Apr. 13, 1999 to Cousins et al. and U.S. Pat. No. 5,649,694 issued Jul. 22, 1997 to Buck teach machine vises with dovetail connected jaws. It would be useful to provide a jaw assembly for vises that would allow use of an inexpensive, easily machined, plate for the jaw that could be replaced with minimal effort and cost.

SUMMARY OF THE INVENTION

It is accordingly an object of the invention to provide a vise jaw plate assembly that can be easily mounted on, and removed from, the jaws of a machine vise. It is another object that the assembly comprise a first reusable component that is readily mounted on, and removed from, a machine vise. It is another object that a second component be made of an easily machinable material that can be discarded after use because it is so inexpensive. It is another object that the second component be readily mounted and removed from the first portion. It is another object that the first and second components be securely connected by an undercut joint such as a dovetail joint so that the second component may be produced by extrusion at minimal cost since it need only be cut to length.

A joint between a male element extending from a surface of a first part, and a recess in a surface of a second part, the recess having a shape corresponding to the male element. The joint holds the parts together when the element is slid into the recess laterally. The element is wider at its free end and narrower at its attached end. The recess has a corresponding reverse shape.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
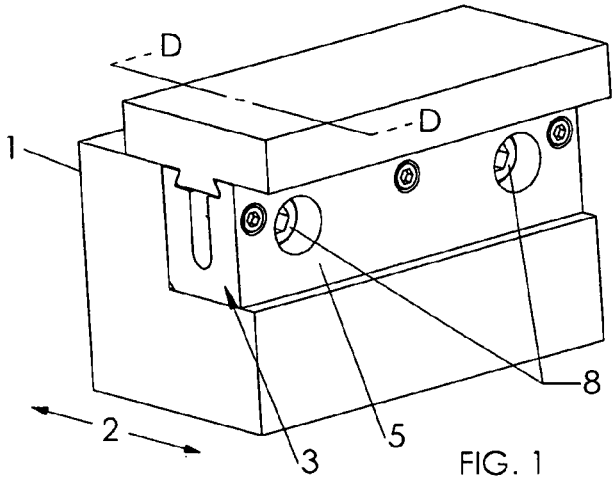
FIG. 1 is a perspective view of the assembly of the invention in place on a vise jaw.
Figure 7:
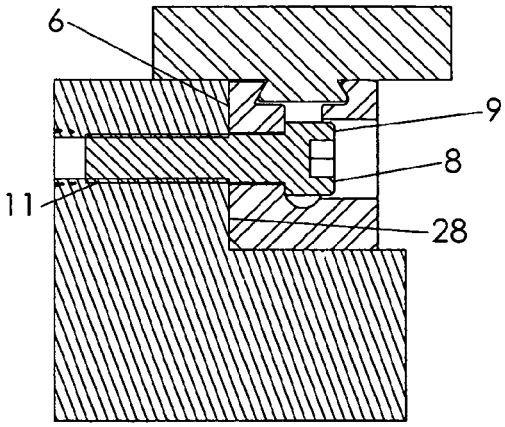
FIG. 7 is a sectional view through line D—D of FIG. 1.
Figure 6:
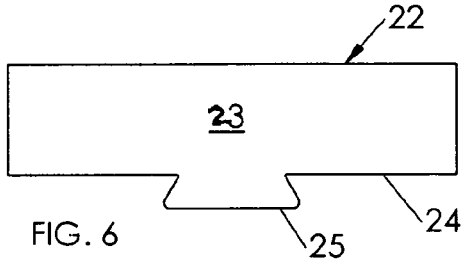
FIG. 6 is a side elevation view of the second component of the invention.
Figure 2:
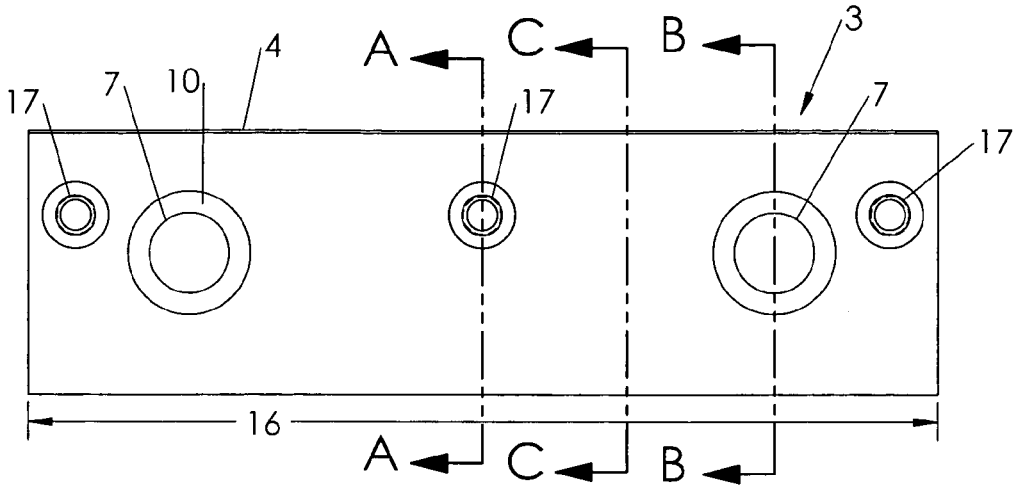
FIG. 2 is a front elevation view of the first component of the invention.
Figure 3:
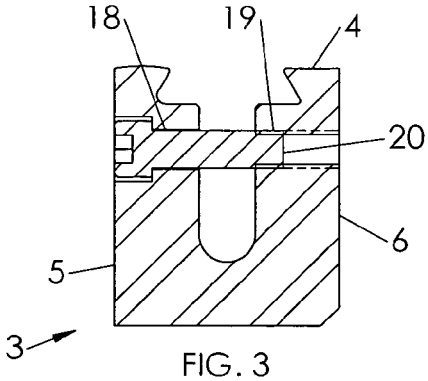
FIG. 3 is a sectional view through line A—A of FIG. 2.
Figure 4:
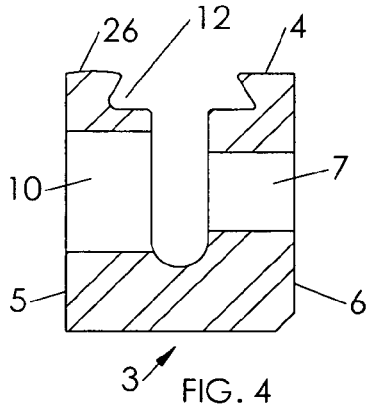
FIG. 4 is a sectional view through line B—B of FIG. 2.
Figure 5:
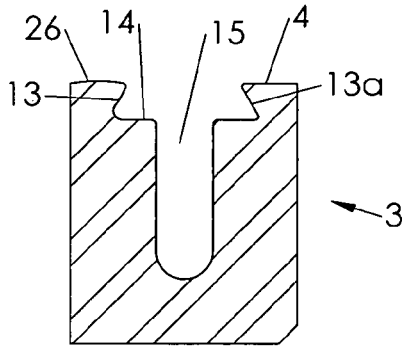
FIG. 5 is a sectional view through line C—C of FIG. 2.

Referring now to the drawing FIGS. 1–7, a vise jaw 1 of the prior art travels in a first direction 2 to clamp or release a work piece against an opposing jaw (not shown). Mounted on jaw 1 is a first, reusable component 3 of the vise jaw plate assembly of the invention by two first fasteners 8 received in first apertures 7 and threadedly engaging threaded holes 11 in the jaw, with fastener heads 9 countersunk in recesses 10. The first component 3 has a top 4, a front face 5, and a rear face 6. The rear face 6 is held tightly against flat face 28 of the jaw by the fasteners 8. A dovetail recess 12 in the top 4 extends the full width 16 of component 3. The recess has side walls 13, 13*a* and a bottom portion 14. A slot 15 extends downward from the bottom portion 14 the full width 16.

A second component 22 of the assembly of the invention is made of an easily machinable material such as an aluminum alloy that has a uniform cross section 23 so that it may be economically produced in large quantities by extrusion, then simply cross cut to size. The second component 22 is designed to be machined at the job site to conform to a particular work piece. The work piece is then clamped in the vise using the assembly and machined. After the job is completed, which may involve machining many work pieces, the second component is discarded or recycled.

The second component 22 has a first face 24. A dovetail connector element 25 extends from the face 24. Element 25 is constructed to mate with dovetail recess 12 when the first face 24 is in contact with the top 4. A plurality of second apertures 17 in the first component include an unthreaded portion 18 and a threaded portion 19. Second fasteners 20 inserted into apertures 17 and tightened contract the slot 15 and pull the side walls 13, 13*a* toward one another to tightly grip the dovetail element 25. A portion 26 of top 4 may be slightly convex, and side wall 13 may also be slightly convex to allow for the slight movement of the upper portion of the first component when the slot is compressed by the fasteners 20.

Figure 8:
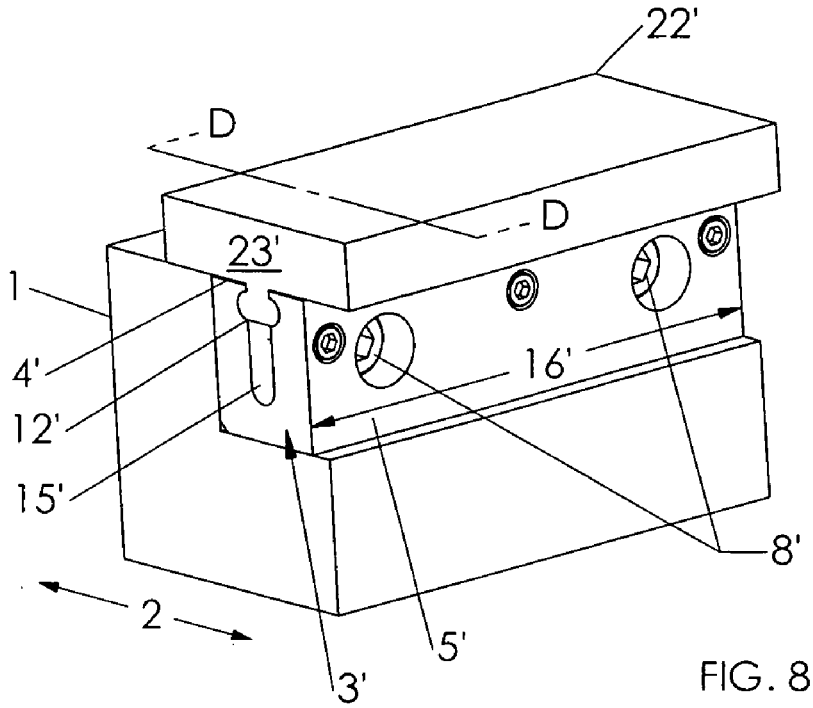
FIG. 8 is a perspective view of the assembly of another embodiment of the invention in place on a vise jaw.
Figure 9:
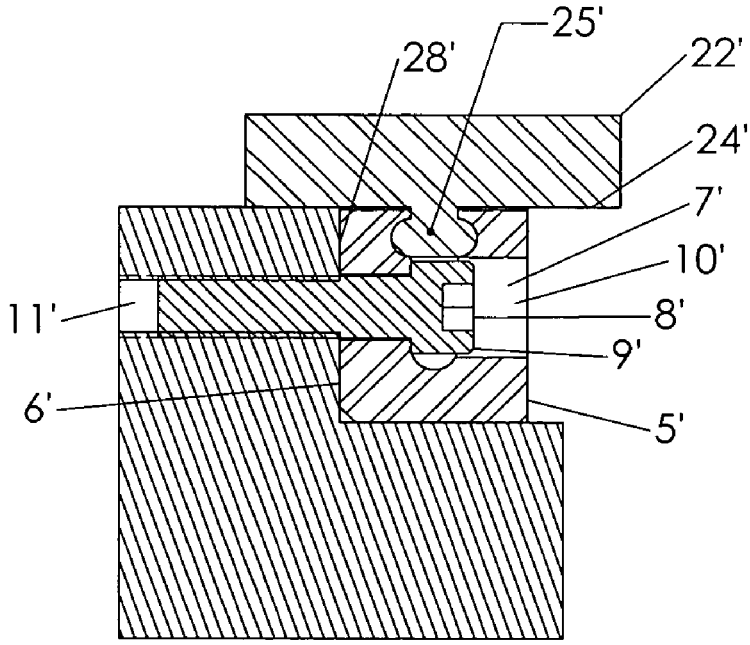
FIG. 9 is a sectional view through line D—D FIG. 8.

Referring now to drawing FIGS. 8 and 9, a vise jaw 1 of the prior art travels in a first direction 2 to clamp or release a work piece against an opposing jaw (not shown). Mounted on jaw 1 is a first, reusable component 3' of the vise jaw plate assembly of the invention by two first fasteners 8' received in first apertures 7' and threadedly engaging threaded holes 11' in the jaw, with fastener heads 9' countersunk in recesses 10'. The first component 3' has a top 4', a front face 5', and a rear face 6'. The rear face 6' is held tightly against flat face 28' of the jaw by the fasteners 8'. A recess 12' in the top 4' extends the full width 16' of component 3'. A slot 15' extends downward from the bottom of the recess the full width 16'.

A second component 22' of the assembly of the invention is made of an easily machinable material such as an aluminum alloy that has a uniform cross section 23' so that it may be economically produced in large quantities by extrusion, then simply cross cut to size. The second component 22' is designed to be machined at the job site to conform to a particular work piece. The work piece is then clamped in the vise using the assembly and machined. After the job is completed, which may involve machining many work pieces, the second component is discarded or recycled.

The second component 22' has a first face 24'. A connector element 25' projects from the face 24. Element 25' is constructed to mate with recess 12' when the first face 24' is in contact with the top 4'. Element 25' has a second portion 29 away from face 4' of a greater thickness than a first portion 30 adjacent face 4'. This results in a secure joint formed when the element 25' is slid laterally into the recess 12'. The second portion 29 may have a substantially cylindrical shape, for example. The shape of the element 25' may vary as desired so long as it provides for the same type of undercut joint. A plurality of second apertures 17' in the first component include an unthreaded portion 18' and a threaded portion 19'. Second fasteners 20' inserted into apertures 17' and tightened contract the slot 15' and pull the side walls 13' toward one another to tightly grip the element 25'.

While we have shown and described the preferred embodiments of our invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A vise jaw plate assembly for mounting on a face of a vise jaw of a vise that is adapted for translatory motion in a first direction, the assembly comprising:

a) a first component having:

i) a top, a front face, and a rear face;

ii) a plurality of first apertures extending in the first direction between the front and rear faces, the apertures constructed for receiving jaw-engaging first fasteners with their fastener heads being recessed below the front face when the rear face is held against the face of the jaw by the first fasteners when received in threaded holes in the jaw face;

iii) a dovetail recess in the top, the recess having opposed side walls and a bottom portion, the recess extending the full width of the first component in a direction transverse to the first direction; and iv) a slot extending downward from the bottom portion, the slot extending the full width of the recess;

b) a second component constructed of a readily machinable, material, the second component having a uniform cross section for formation by an extrusion process, and having:

i) a first face; and ii) a dovetail connector element projecting from the first face, the connector element extending along the full width of the face, the connector element constructed to mate securely with the dovetail recess in the first component while the first face is in close contact with the top of the first component; and c) a plurality of second apertures extending in the first direction between the front and rear faces of the first component, the second apertures having a first unthreaded portion between the front face and the slot and a second, threaded portion between the slot and the rear face, the second apertures constructed for receiving therein second fasteners for threadedly engaging the second, threaded portion with fastener heads being recessed below the front face to thereby contract the slot, and securely hold the dovetail element of the second component within the recess.

2. The assembly according to claim 1 in which the material of the second component comprises aluminum alloy.

3. The assembly according to claim 1 in which the top of the first component between the rear face and the recess is flat and the top of the first component between the recess and the front face is convex.

4. The assembly according to claim 3 in which the side wall of the recess adjacent the front face is convex.

5. The assembly according to claim 1 in which the top of the first component between the front face and the recess is flat and the top of the first component between the recess and the rear face is convex.

6. The assembly according to claim 5 in which the side wall of the recess adjacent the rear face is convex.

7. In a vise jaw plate assembly for mounting on a face of a vise jaw of a vise that is adapted for translatory motion in a first direction, with a first component having:

i) a top, a front face, and a rear face;

ii) a plurality of first apertures extending in the first direction between the front and rear faces, the apertures constructed for receiving jaw-engaging first fasteners with fastener heads being recessed below the front face when the rear face is held against a face of the jaw by the first fasteners when received in threaded holes in the jaw face;

iii) a dovetail recess in the top, the recess extending in a direction transverse to the first direction; and iv) a slot extending downward from the recess bottom, the slot extending the length of the recess;

v) a plurality of second apertures extending in the first direction between the front and rear faces, the second apertures having a first unthreaded portion between the front face and the slot and a second, threaded portion between the slot and the rear face, the second apertures constructed for receiving therein second fasteners for threadedly engaging the second, threaded portion with fastener heads being recessed below the front face to thereby contract the slot, and securely hold a dovetail element within the recess, the improvement comprising:

A) a second component constructed of a readily machinable, material, the second component having a uniform cross section for formation by an extrusion process, and having:

i) a first face; and ii) a dovetail connector element projecting from the first face, the connector element extending along the full length of the first face, the connector element constructed to mate securely within the dovetail recess in the first component while the first face is in close contact with the top of the first component when the second fasteners are tightened.

8. The invention according to claim 7 in which the material of the second component comprises aluminum alloy.

9. A vise jaw plate assembly for mounting on a face of a vise jaw of a vise that is adapted for translatory motion in a first direction, the assembly comprising:

a) a first component having:

i) a top, a front face, and a rear face;

ii) a plurality of first apertures extending in the first direction between the front and rear faces, the apertures constructed for receiving jaw-engaging first fasteners with their fastener heads being recessed below the front face when the rear face is held against the face of the jaw by the first fasteners when received in threaded holes in the jaw face;

iii) a recess in the top, the recess having opposed side walls and a bottom portion, the recess extending the full width of the component in a direction transverse to the first direction; and iv) a slot extending downward from the bottom portion, the slot extending the full width of the recess;

b) a second component constructed of a readily machinable, material, the second component having a uniform cross section for formation by an extrusion process, and having:

i) a first face; and ii) a connector element projecting from the first face, the connector element extending along the full width of the face, and having a second portion away from the first face that is of a greater thickness than a first portion adjacent the first face, the connector element constructed to correspond in shape and to mate securely with the recess in the first component while the first face is in close contact with the top of the first component; and c) a plurality of second apertures extending in the first direction between the front and rear faces of the first component, the second apertures having a first unthreaded portion between the front face and the slot and a second, threaded portion between the slot and the rear face, the second apertures constructed for receiving therein second fasteners for threadedly engaging the second, threaded portion with fastener heads being recessed below the front face to thereby contract the slot, and securely hold the connector element of the second component within the recess.

10. The assembly according to claim 9 in which the material of the second component comprises aluminum alloy.

11. The assembly according to claim 10 in which the top of the first component between the rear face and the recess is flat and the top of the first component between the recess and the front face is convex.

12. The assembly according to claim 11 in which the side wall of the recess adjacent the front face is convex.

13. The assembly according to claim 10 in which the top of the first component between the front face and the recess is flat and the top of the first component between the recess and the rear face is convex.

14. The assembly according to claim 13 in which the side wall of the recess adjacent the rear face is convex.

15. The assembly according to claim 10 in which the second portion of the connector element is substantially cylindrical in shape.

16. In a vise jaw plate assembly for mounting on a face of a vise jaw of a vise that is adapted for translatory motion in a first direction, with a first component having:

a) a top, a front face, and a rear face;

b) a plurality of first apertures extending in the first direction between the front and rear faces, the apertures constructed for receiving jaw-engaging first fasteners with fastener heads being recessed below the front face when the rear face is held against a face of the jaw by the first fasteners when received in threaded holes in the jaw face;

d) a recess in the top, the recess extending in a direction transverse to the first direction; and e) a slot extending downward from the recess bottom, the slot extending the length of the recess; and f) a plurality of second apertures extending in the first direction between the front and rear faces, the second apertures having a first unthreaded portion between the front face and the slot and a second, threaded portion between the slot and the rear face, the second apertures constructed for receiving therein second fasteners for threadedly engaging the second, threaded portion with fastener heads being recessed below the front face to thereby contract the slot, and securely hold a connector element within the recess, the improvement comprising:

A) a second component constructed of a readily machinable material, the component having a uniform cross section for formation by an extrusion process, and having:

i) a first face; and ii) a connector element projecting from the first face, the connector element extending along the full length of the face, and having a second portion away from the first face that is of a greater thickness than a first portion adjacent the first face, the element constructed to correspond in shape and to mate securely within the joint recess in the first component while the first face is in close contact with the top of the first component when the second fasteners are tightened.

17. The invention according to claim 16 in which the material of the second component comprises aluminum alloy.

18. The assembly according to claim 17 in which the second portion of the connector element is substantially cylindrical in shape.

* * * * *